US008870528B2

(12) United States Patent
Teramoto et al.

(10) Patent No.: US 8,870,528 B2
(45) Date of Patent: Oct. 28, 2014

(54) VENTILATION FAN

(75) Inventors: Takuya Teramoto, Kyoto (JP); Hiroyoshi Teshima, Kyoto (JP)

(73) Assignee: Nidec Corporation, Kyoto (JP)

( * ) Notice: Subject to any disclaimer, the term of this patent is extended or adjusted under 35 U.S.C. 154(b) by 464 days.

(21) Appl. No.: 13/406,556

(22) Filed: Feb. 28, 2012

(65) Prior Publication Data

US 2012/0230815 A1 Sep. 13, 2012

(30) Foreign Application Priority Data

Mar. 8, 2011 (JP) ..... 2011-049878

(51) Int. Cl.

| | |
|---|---|
| ***F04D 29/66*** | (2006.01) |
| ***F04D 25/08*** | (2006.01) |
| ***F04D 25/06*** | (2006.01) |
| ***F04D 29/02*** | (2006.01) |

(52) U.S. Cl.

CPC ..... *F04D 25/0613* (2013.01); *F04D 25/082* (2013.01); *F04D 29/023* (2013.01)

USPC ..... 415/119; 415/220

(58) Field of Classification Search

CPC ..... F04D 19/002; F04D 25/082; F04D 25/12; F04D 29/52; F04D 29/58; F04D 29/5806; F04D 29/5813; F04D 29/522; F04D 29/04

USPC ..... 415/232, 220, 180, 914, 177, 211.1, 415/119

See application file for complete search history.

(56) References Cited

U.S. PATENT DOCUMENTS

| | | | | |
|---|---|---|---|---|
| 3,961,864 | A * | 6/1976 | Papst et al. | 417/354 |
| 5,957,659 | A * | 9/1999 | Amou et al. | 415/178 |
| 6,085,878 | A | 7/2000 | Araki et al. | |
| 6,472,043 | B1 | 10/2002 | Kobayashi et al. | |
| 7,416,387 | B2 * | 8/2008 | Lan et al. | 415/211.2 |
| 2002/0061145 | A1 * | 5/2002 | Kobayashi et al. | 384/276 |
| 2006/0039784 | A1 | 2/2006 | Yan et al. | |
| 2006/0098332 | A1 | 5/2006 | Lee et al. | |
| 2007/0065064 | A1 | 3/2007 | Kitamura et al. | |
| 2009/0081036 | A1 * | 3/2009 | Takeshita et al. | 415/208.2 |
| 2009/0180901 | A1 | 7/2009 | Lee et al. | |

FOREIGN PATENT DOCUMENTS

| | | | |
|---|---|---|---|
| CN | 2585107 | Y | 11/2003 |
| CN | 1773624 | A | 5/2006 |
| JP | 05-307394 | A | 11/1993 |
| JP | 06-017796 | A | 1/1994 |
| JP | 2002-155939 | A | 5/2002 |
| JP | 2006-057631 | A | 3/2006 |

* cited by examiner

*Primary Examiner* — Dwayne J White
*Assistant Examiner* — Jason Fountain
(74) *Attorney, Agent, or Firm* — Keating & Bennett, LLP

(57) ABSTRACT

A ventilation fan arranged to reduce vibrations includes an impeller rotating around a center axis, a motor portion arranged to rotate the impeller, a motor supporting portion arranged to support the motor portion, and a housing arranged to accommodate the impeller and the motor portion. The motor supporting portion includes a substantially disk-shaped base portion, and a substantially cylindrical bearing holding portion axially extending with the center axis as the center. At least the base portion is made from resin. On the surface of the base portion, a plurality of recessed portions which are axially recessed are arranged in the form of a net, a staggered pitch, a grid, or a honeycomb. A flat portion of the base portion excluding the recessed portions does not have a continuous region extending in a straight line radially from the center of the base portion.

15 Claims, 6 Drawing Sheets

VENTILATION FAN

BACKGROUND OF THE INVENTION

1. Field of the Invention

The present invention relates to a ventilation fan and more specifically, to a ventilation fan used for cooling electronic equipment or other purposes.

2. Description of the Related Art

Generally, a conventional ventilation fan includes a housing which includes a cavity portion, an impeller accommodated in the housing, a motor portion arranged to rotate the impeller, and a motor supporting portion arranged to support the motor portion. The motor portion is provided with a stator portion and a rotor portion. The rotor portion is supported via bearings in a rotatable manner with respect to the stator portion. The motor supporting portion includes a bearing supporting portion arranged to support the bearings and a stator, and a base portion coupled to the housing. With such a configuration, the motor supporting portion is supported by the housing and supports a rotatable rotor portion.

The supporting of the motor supporting portion to the housing is realized in the following way. In the case of an axial fan, the base portion of the motor supporting portion is coupled to the housing via a plurality of ribs. In the case of a centrifugal fan, the base portion of the motor supporting portion is directly coupled to the housing, or the base portion is coupled to the housing via a plurality of ribs. In addition, the housing and the motor supporting portion (i.e., the bearing supporting portion and the base portion) including the ribs may be integrally molded by a resin, thereby reducing the number of components.

In association with the increase in density of heat generating electronic components or the like mounted in the electronic equipment, the ventilation fan is required to improve its cooling performance. For this purpose, the impeller is rotated at high-speed to increase the amount of airflow.

However, as the rotation speed of the impeller is increased, vibrations caused by the rotation of the impeller are transmitted to the motor supporting potion and the housing via the bearings. As a result, the vibrations are transmitted to the actual device to which the motor is attached, so that there is concern about the occurrence of some defect in the actual device caused by the vibrations. Especially in the case when the motor supporting portion and the housing are integrally molded by a resin, it is difficult for the vibrations to be attenuated. Accordingly, the vibrations caused by the rotation of the impeller are easily transmitted to the actual device to which the motor is attached.

For solving such a problem, (JP-A-2006-57631) discloses a technique for forming a plurality of reinforcing ribs in the base portion. With such a configuration, the motor supporting portion is reinforced, so that it is possible to reduce the transmission of vibrations.

However, even when the base portion is reinforced by forming the reinforcing ribs, it is still insufficient to substantially reduce transmission of the vibrations to the housing via the base portion.

SUMMARY OF THE INVENTION

In order to overcome the problems described above, preferred embodiments of the present invention provide a ventilation fan which can be easily produced, and which is capable of reducing vibrations.

A ventilation fan according to a preferred embodiment of the present invention preferably includes an impeller arranged to rotate around a center axis; a motor portion arranged to rotate the impeller; a motor supporting portion arranged to support the motor portion; and a housing arranged to accommodate the impeller and the motor portion, wherein the motor supporting portion preferably includes a substantially disk-shaped base portion, and a substantially cylindrical bearing holding portion axially extending with the center axis of the impeller as the center, at least the base portion being made from a resin, a plurality of recessed portions which are axially recessed are arranged in a net configuration on at least one of an upper surface and a lower surface of the base portion, and a flat portion of the base portion that does not include the recessed portions does not include a continuous region radially extending along a radial direction from the center of the base portion.

According to various preferred embodiments of the present invention, it is possible to easily produce a ventilation fan which can reduce vibrations.

The above and other elements, features, steps, characteristics and advantages of the present invention will become more apparent from the following detailed description of the preferred embodiments with reference to the attached drawings.

DETAILED DESCRIPTION OF PREFERRED EMBODIMENTS

Referring to FIGS. 1 through 6, preferred embodiments of the present invention will be described below in detail. It should be noted that in the explanation of preferred embodiments of the present invention, "an axial direction" indicates a direction parallel or substantially parallel to a center axis, and "a radial direction" indicates a direction perpendicular or substantially perpendicular to the center axis. In addition, the present invention is not limited to the preferred embodiments which will be described below. Moreover, the preferred embodiments may appropriately be modified without departing from the range in which the effects and advantages of the present invention can be attained. Moreover, various features and characteristics of one preferred embodiment may be combined with another preferred embodiment.

Figure 1:
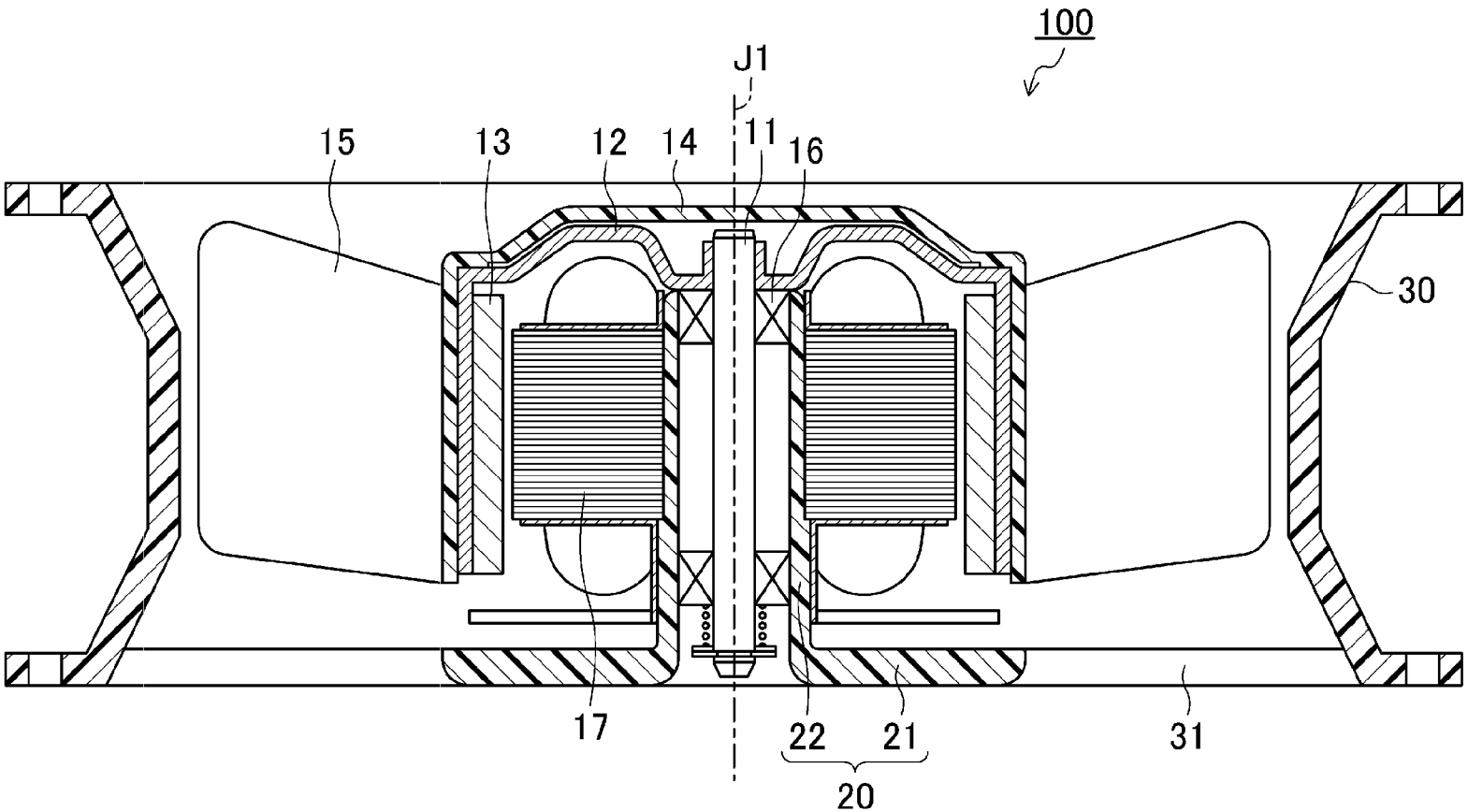
FIG. 1 is a sectional view showing the configuration of a ventilation fan according to a preferred embodiment of the present invention.

FIG. 1 is a sectional view schematically showing the configuration of a ventilation fan 100 according to a preferred embodiment of the present invention. The ventilation fan 100 described in the present preferred embodiment is an axial fan provided with a motor of outer rotor type. However, the present invention is not limited to this, and can be applied to a centrifugal fan, a fan including an inner rotor motor, etc.

As shown in FIG. 1, the ventilation fan 100 in the present preferred embodiment includes an impeller arranged to rotate around a center axis J1, a motor portion arranged to rotate the impeller, a motor supporting portion 20 arranged to support the motor portion, and a housing 30 arranged to accommodate the impeller and the motor portion.

The motor portion preferably includes a rotor magnet 13 which rotates around the center axis J1 together with a shaft 11, and a stator 17 located on a radially inner side of the rotor magnet 13. The rotor magnet 13 is preferably attached to an inner side surface of a substantially cylindrical yoke 12 fixed to the shaft 11. The yoke 12 and the rotor magnet 13 define a rotor. On an outer side surface of the yoke 12, an impeller cup 14 is fixed. The impeller cup 14 and a plurality of blades 15 provided on an outer circumference of the impeller cup 14 define an impeller.

The motor supporting portion 20 preferably includes a substantially disk-shaped base portion 21, and a substantially cylindrical bearing holding portion 22 which extends in the axial direction with the center axis J1 as a center. The bearing holding portion 22 supports the shaft 11 to be rotatable via a bearing 16. The stator 17 is preferably fixed to an outer circumference of the bearing holding portion 22. A radially outer end portion of the base portion 21 is coupled to an inner side portion of the housing 30 preferably through a plurality of ribs 31. With such a configuration, the motor supporting portion 20 is supported by the housing 30, and supports the rotor and the impeller rotatable. In addition, a hollow portion of which both of the axially end portions are opened is defined in the housing 30. Thus, the air flows in the axial direction by the rotation of the impeller.

In the present preferred embodiment, at least the base portion 21 is preferably made from a resin material. Alternatively, the base portion 21, the housing 30, and the ribs 31 may all made of molded resin to thereby be provided as a unitary monolithic member. Additionally, the bearing holding portion 22 may also be integrally provided by being embedded within the unitary monolithic member.

In order to reduce vibrations transmitted to the motor supporting portion 20 via the bearing 16 when the rotation speed of the impeller is increased, it is effective to increase the rigidity of the base portion 21. However, if the thickness of the base portion 21 is increased for the purpose of increasing the rigidity of the base portion 21, it is possible that, for example, a shrink mark (i.e., a deformation caused by thermal contraction) may be generated in the resin molding.

In order to prevent the occurrence of, for example, shrink marks, preferred embodiments of the present invention provide a portion having a reduced thickness, i.e., a so-called reduced thickness portion on the surface of the base portion. When the vibrations transmitted to the base portion 21 were analyzed, it was discovered that the degree of reduction of vibrations varied depending on the formation of the reduced thickness portions.

Figure 2A:
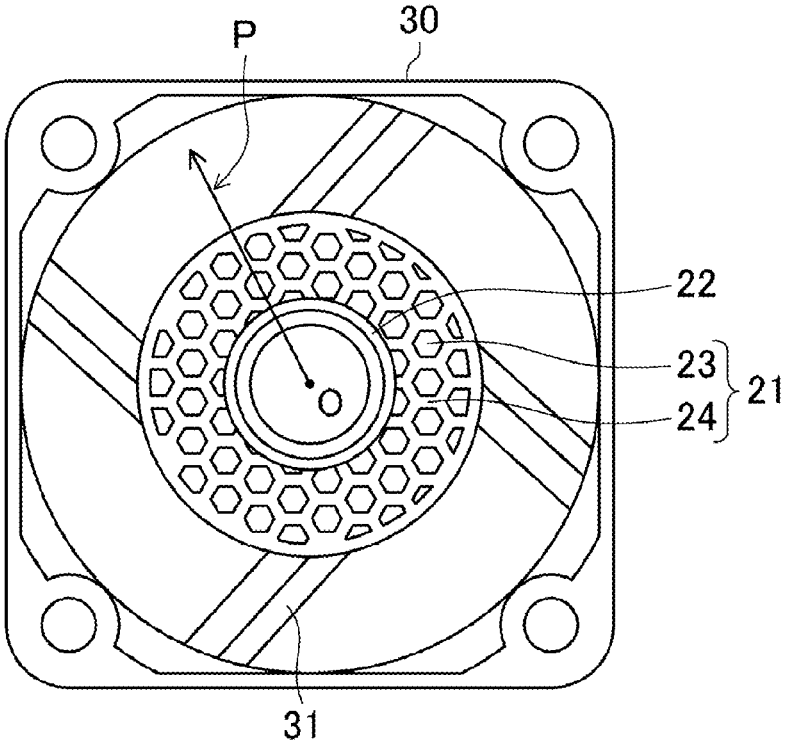
FIG. 2A and FIG. 2B are plan views showing the configuration of a motor supporting portion including reduced thickness portions (recessed portions) on a surface of a base portion.
Figure 2B:
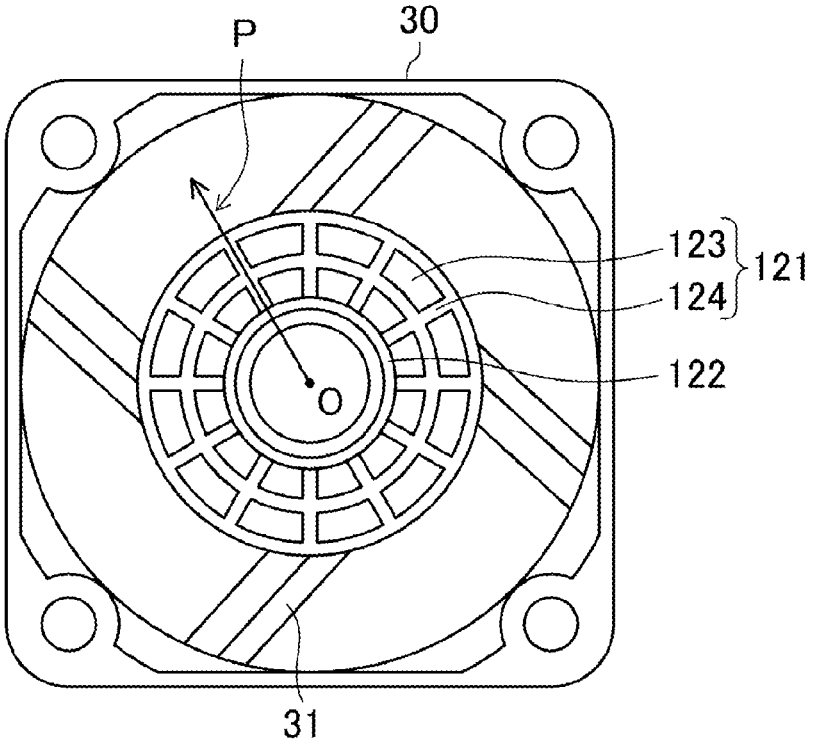

FIGS. 2A and 2B are plan views showing the configuration of the motor supporting portion 20 in which reduced thickness portions are provided on the surface of the base portion 21, respectively. The vibrations transmitted to the base portion 21 are more effectively reduced in the motor supporting portion having the configuration shown in FIG. 2A than in the motor supporting portion having the configuration shown in FIG. 2B. On the surface of the base portion 21, recessed portions 23 which are axially recessed corresponding to the reduced thickness portions are preferably provided in the form of, for example, a net, a staggered pitch, a grid, or a honeycomb, as shown in FIG. 2A. On the radially inner side of the substantially disk-shaped base portion 21, a substantially cylindrical bearing holding portion 22 is provided. The radially outer end portion of the base portion 21 is coupled to the inner side portion of the housing 30 preferably through the plurality of ribs 31.

The following are the reasons why the degree of reduction of vibrations varies depending on the formation of the recessed portions (the reduced thickness portions).

In the base portion 121 having the configuration shown in FIG. 2B, a flat portion 124 of the base portion 121 excluding the recessed portions 123 includes a continuous region extending in a straight line radially along the radial direction P from the center O of the base portion 121 (the intersection of the base portion 121 and the center axis J1). Therefore, in the base portion 121, the linearly continuous flat portion 124 along a line segment passing through the center O is the shortest path to transmit the vibrations, so that it is difficult to reduce the vibrations.

On the other hand, in the base portion 21 having the configuration shown in FIG. 2A, a flat portion 24 of the base portion 21 excluding the recessed portions 23 has no continuous region radially extending along the radial direction P from the center O of the base portion 21 (the intersection of the base portion 121 and the center axis J1). Therefore, in the base potion 21, since the flat portion 24 spreads in a zigzag manner, for example, the transmission of vibration is dispersed. As a result, the vibration can be effectively reduced.

Specifically, in order to reduce the vibration caused by the rotation and transmitted to the motor supporting portion 20 (the base portion 21) via the bearing 16, the ventilation fan 100 of the present preferred embodiment includes the impeller rotating around the center axis J1, the motor portion arranged to rotate the impeller, the motor supporting portion 20 arranged to support the motor portion, and the housing 30 arranged to accommodate the impeller and the motor portion. The motor supporting portion 20 includes the substantially disk-shaped base portion 21, and the substantially cylindrical bearing holding portion 22 axially extending with the center axis J1 as the center. At least the base portion 21 is preferably made from a resin. On at least one of the upper surface and the lower surface of the base portion 21, a plurality of recessed portions 23 which are axially recessed are arranged in the form of, for example, a net, a staggered pitch, a grid, or a honeycomb. The flat portion 24 of the base portion 21 excluding the recessed portions 23 has no continuous region radially extending along the radial direction from the center of the base portion 21.

In the present preferred embodiment, the flat portion 24 of the base portion 21 excluding the recessed portions 23 has no continuous region radially extending along the radial direction from the center of the base portion 21, as described above. With such a configuration, even if the vibrations are transmitted to the motor supporting portion 20 via the bearing 16, the vibrations can be dispersed in the transmission by way of the flat portion 24. Therefore, it is possible to reduce the vibrations transmitted to the base portion 21. In addition, the recessed portions 23 are provided as so-called reduced thickness portions when the base portion 21 is made from a resin molded material, thereby preventing and suppressing the occurrence of shrink marks in the resin molding. Accordingly, the thickness of the base portion 21 can be increased, so as to increase the rigidity of the base portion 21. In addition, the recessed portions 23 of the base portion 21 are formed as the reduced thickness portions in the resin molding, so that they can be easily formed by, for example, an injection molding technique with a die.

In various preferred embodiments of the present invention, the effect of reducing the vibrations transmitted to the base portion 21 can be attained if the flat portion 24 has no continuous region extending in a straight line radially along the radial direction from the center of the base portion 21, and the shape and the arrangement of the recessed portions 23 are not specifically limited.

Figure 3A:
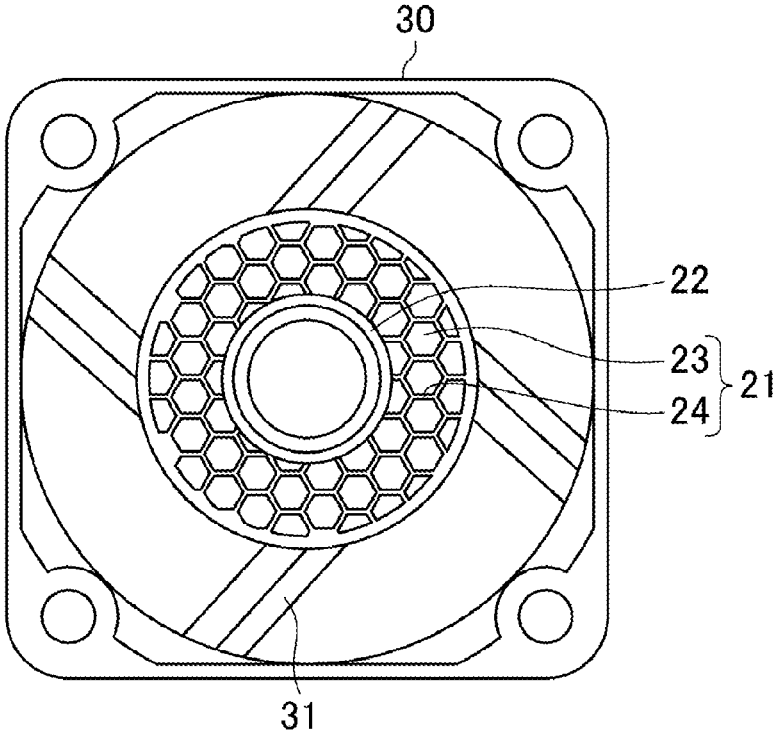
FIG. 3A and FIG. 3B are plan views showing exemplary arrangements of the recessed portions in the base portion.
Figure 3B:
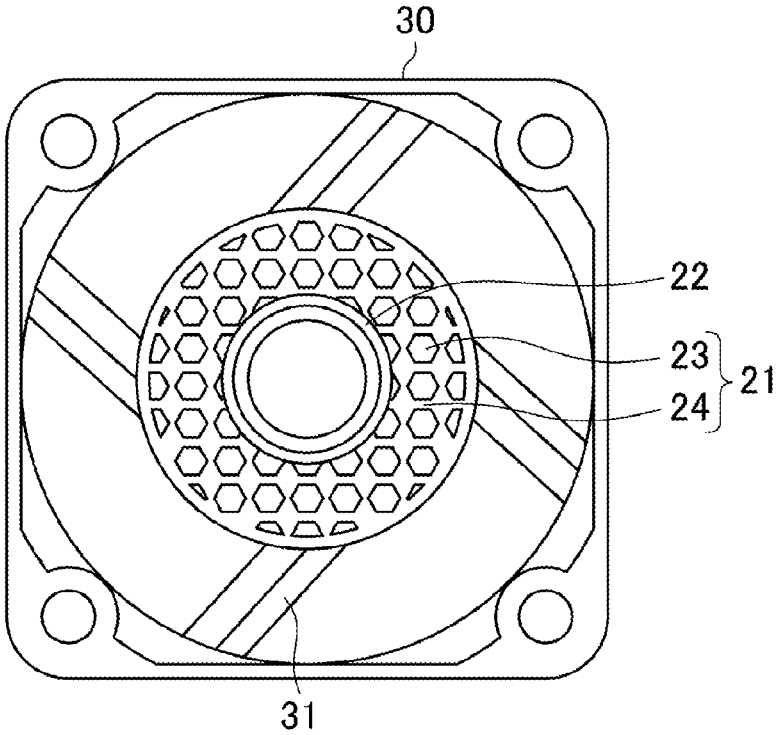

FIGS. 3A and 3B are plan views showing other preferred embodiments of exemplary arrangements of the recessed portions 23 in the base portion 21.

In the base portion 21 shown in FIG. 3A, a plurality of recessed portions 23 are arranged in the form of a honeycomb. Herein the term "arrangement in the form of a honeycomb" represents the arrangement in which the plurality of recessed portions 23 are segmented by the flat portion (i.e., a partition) 24 having a certain width. The shape of the respective recessed portion 23 is not limited to a hexagon, but may alternatively be, for example, a circle, other polygons (e.g., a square, a triangle), or the like.

In the base portion 21 shown in FIG. 3B, a plurality of recessed portions 23 are arranged in the form of a grid. Herein the term "arrangement in the form of a grid" represents the arrangement in which the plurality of recessed portions 23 are arranged at regular or substantially regular intervals on mutually intersecting straight lines. In the base portion 21 shown in FIG. 3B, the recessed portions 23 each having a hexagon shape are arranged on mutually orthogonal straight lines. However, it should be noted that the shape of the respective recessed portions 23 is not limited to a hexagon, but may alternatively be, for example, a circle, a square, a triangle, or the like.

FIGS. 4A to 4D are plan views showing other exemplary arrangements of the recessed portions 23 in the base portion 21.

Figure 4A:
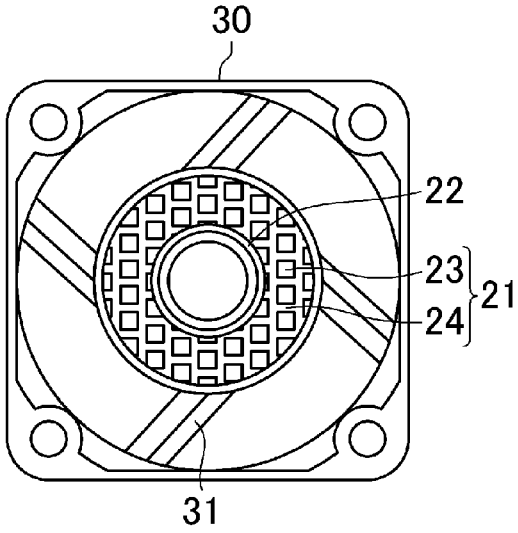
FIGS. 4A to 4D are plan views showing other exemplary arrangements of the recessed portions in the base portion.

In the base portion 21 shown in FIG. 4A, recessed portions each having a square shape are arranged to have a staggered pitch.

Figure 4B:
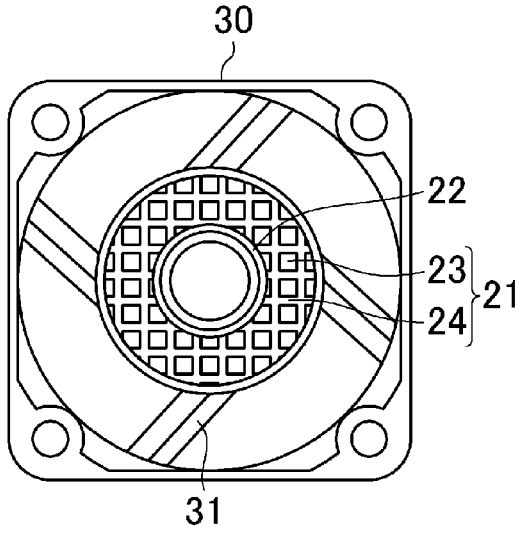

In the base portion 21 shown in FIG. 4B, recessed portions each having a square shape are arranged in the form of a grid.

Figure 4C:
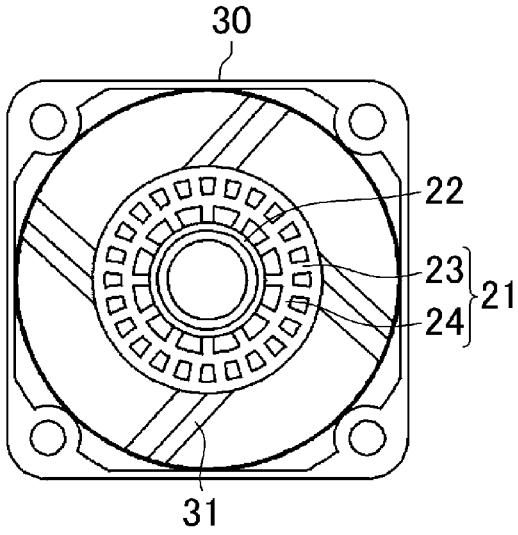

In the base portion 21 shown in FIG. 4C, the number of recessed portions 23 arranged on the radially inner side in a circumferential direction is less than, and preferably half of, the number of recessed portions 23 arranged on the radially outer side in the circumferential direction. If the number of the recessed portions 23 arranged on the radially inner side in the circumferential direction and the number of the recessed portions 23 arranged on the radially outer side in the circumferential direction are co-prime, a region of the flat portion 24 linearly extending along a line segment passing through the center axis J1 can be omitted such that there is no continuous region extending in a straight line radially along the radial direction from the center of the base portion 21.

Figure 4D:
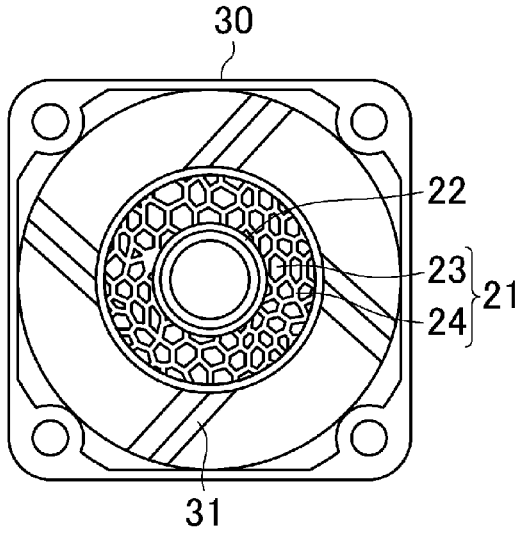

In the base portion 21 shown in FIG. 4D, recessed portions 23 having different shapes and sizes are arranged at random intervals (i.e., arranged non-uniformly).

In order to increase the strength of the base portion 21, the ratio of area of the recessed portions 23 arranged in the circumferential direction to the flat portion 24 on the radially outer side is preferably smaller than that on the radially inner side.

Figure 5:
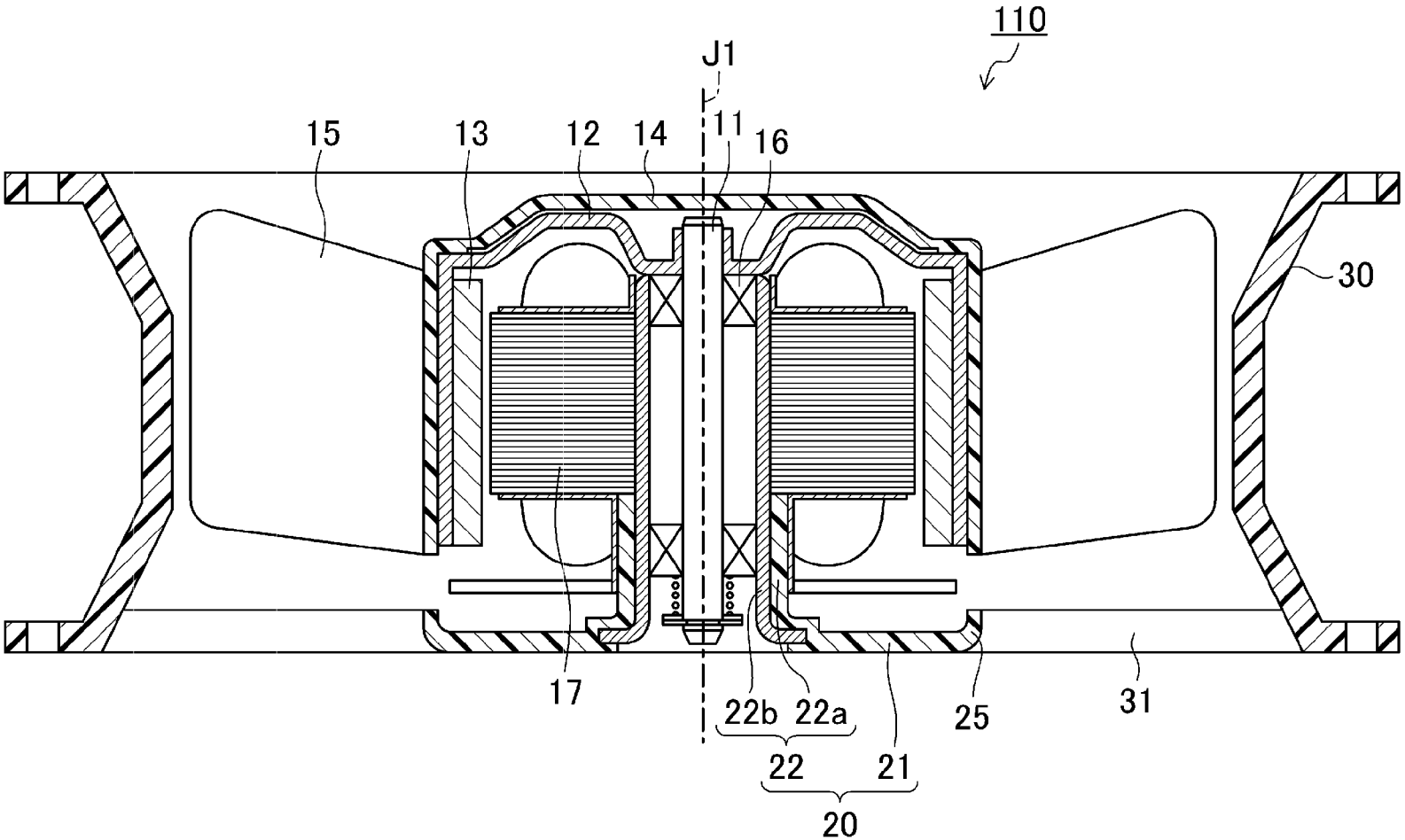
FIG. 5 is a sectional view showing the configuration of a ventilation fan according to another preferred embodiment of the present invention.

FIG. 5 is a sectional view schematically showing the configuration of a ventilation fan 110 in accordance with another preferred embodiment of the present invention. The ventilation fan 110 which will be exemplarily described in the present preferred embodiment is also an axial fan provided with a motor of outer rotor type, similarly to the ventilation fan 100 shown in FIG. 1.

The ventilation fan 110 in the present preferred embodiment is different from the ventilation fan 100 shown in FIG. 1 in that the bearing holding portion 22 of the motor supporting portion 20 is defined by a resin portion 22*a* and a metal portion 22*b*, and in that an annular wall portion 25 is defined in the radially outer end portion of the base portion 21 of the motor supporting portion 20.

The metal portion 22*b* of the bearing holding portion 22 arranged to support the bearing 16 improves the strength of the bearing holding portion 22, and the bearing holding portion 22 is defined by the resin portion 22*a* and the metal portion 22*b*, which are made of different materials, thereby the vibrations transmitted to the base portion 21 can be further reduced. In addition, by providing the annular wall portion 25 in the radially outer end portion of the base portion 21, the strength of the base portion 21 can be further improved.

Moreover, in the present preferred embodiment, the metal portion 22*b* of the bearing holding portion 22 may be provided in the base portion 21 by, for example, being embedded therein through insert molding, thereby integrally providing the housing 30, the ribs 31, and the motor supporting portion 20 at the same time.

Figure 6:
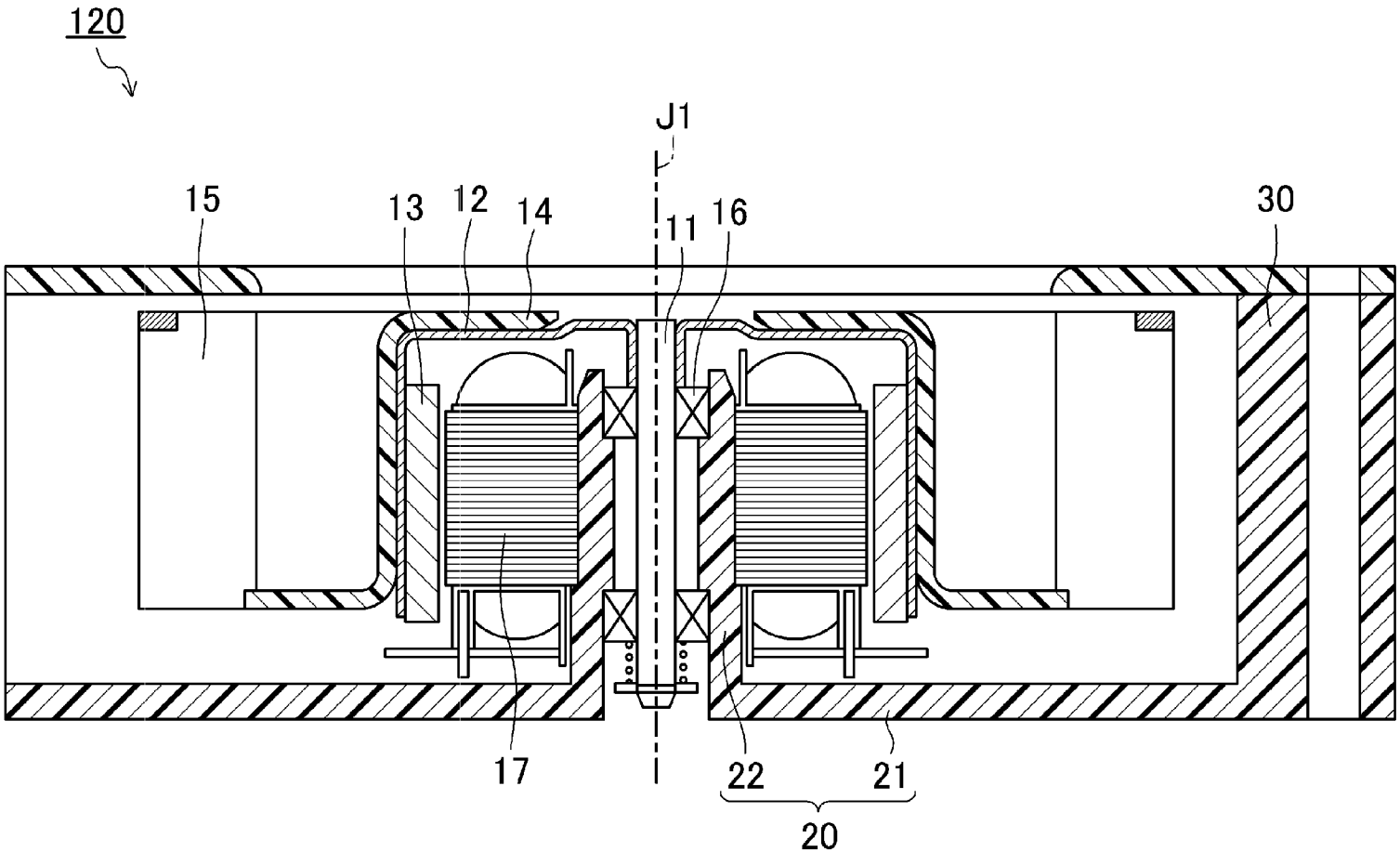
FIG. 6 is a sectional view showing the configuration of a ventilation fan according to another preferred embodiment of the present invention.

FIG. 6 is a sectional view schematically showing the configuration of a ventilation fan 120 in another preferred embodiment of the present invention. The ventilation fan 120 which will be exemplarily described in the present preferred embodiment is a centrifugal fan provided with a motor of outer rotor type.

The ventilation fan 120 in the present preferred embodiment is different from the ventilation fan 100 shown in FIG. 1 in that the radially outer end portion of the base portion 21 is coupled to an inner side portion of the housing 30.

In the present preferred embodiment, the housing 30 and the motor supporting portion 20 may be integrally provided.

Also in the ventilation fans 110 and 120 shown in FIGS. 5 and 6, on at least one of an upper surface and a lower surface of the base portion 21, a plurality of recessed portions 23 which are axially recessed are arranged in the form of a net, a staggered pitch, a grid, or a honeycomb, and a flat portion 24 of the base portion 21 excluding the recessed portions 23 has no continuous region extending in a straight line radially along the radial direction from the center of the base portion 21.

It is noted that the recessed portions 23 provided in the base portion 21 in the present invention are preferably arranged as so-called reduced thickness portions. In order to prevent the occurrence of shrink marks in the resin molding of the base portion 21, it is preferred that the area ratio of the recessed portions 23 to the flat portion 24 on the radially inner side is made to be equal or substantially equal to that on the radially outer side, other than the outermost circumference and the innermost circumference of the base portion 21. Alternatively, it is preferred that the number of the recessed portions 23 arranged in the circumferential direction is gradually increased toward the radially outer side.

The present invention is described by way of preferred embodiments thereof. However, the descriptions of the preferred embodiments are not limited to only the features explicitly discussed above, but can also be variously modified. For example, in the above-described preferred embodiments, the ventilation fan provided with the motor of outer rotor type is described, but the present invention can also be applied to a ventilation fan with a motor of inner rotor type.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A ventilation fan comprising:

an impeller arranged to rotate around a center axis;

a motor portion arranged to rotate the impeller;

a motor supporting portion arranged to support the motor portion; and a housing arranged to accommodate the impeller and the motor portion; wherein the motor supporting portion includes a substantially disk-shaped base portion and a substantially cylindrical bearing holding portion extending axially with the center axis as the center, at least the base portion being made from a resin material;

on at least one of an upper surface and a lower surface of the base portion, a plurality of recessed portions which are axially recessed; and a flat portion of the base portion excluding the recessed portions does not have a continuous region extending in a straight line radially along a radial direction from the center of the base portion.

2. A ventilation fan according to claim 1, wherein each of the plurality of recessed portions has a shape of a circle or a polygon.

3. A ventilation fan according to claim 1, wherein an area ratio of the recessed portions to the flat portion on a radially inner side is equal to or bigger than an area ratio of the recessed portions to the flat portion on a radially outer side.

4. A ventilation fan according to claim 1, wherein a number of the recessed portions arranged in a circumferential direction is gradually increased toward a radially outer side.

5. A ventilation fan according to claim 1, wherein a number of the recessed portions arranged in a circumferential direction on a radially inner side and a number of the recessed portions arranged in the circumferential direction on a radially outer side are co-prime to each other.

6. A ventilation fan according to claim 1, wherein the plurality of recessed portions are arranged to define a net, a staggered pitch, a honeycomb or a grid.

7. A ventilation fan according to claim 1, wherein the recessed portions are arranged non-uniformly in size or non-uniformly in form on at least one of an upper surface and a lower surface of the base portion.

8. A ventilation fan according to claim 1, wherein the base portion includes an annular wall portion defined in a radially outer end portion.

9. A ventilation fan according to claim 1, wherein the recessed portions are provided on the upper surface and the lower surface of the base portion.

10. A ventilation fan according to claim 1, wherein the ventilation fan is an axial fan; and a radially outer end portion of the base portion is coupled to an inner side portion of the housing through a plurality of ribs.

11. A ventilation fan according to claim 10, wherein the housing, the base portion, and the ribs are provided as a single monolithic member.

12. A ventilation fan according to claim 1, wherein the bearing holding portion is defined by a metal portion and a resin portion, and the metal portion is embedded in the resin portion by being molded therein.

13. A ventilation fan according to claim 1, wherein the ventilation fan is a centrifugal fan; and a radially outer end portion of the base portion is coupled to an inner side potion of the housing.

14. A ventilation fan according to claim 13, wherein the housing and the base potion are provided as a single monolithic member.

15. A ventilation fan according to claim 1, wherein the base portion is made from molded resin.

* * * * *